US011391067B2

(12) United States Patent
George et al.

(10) Patent No.: US 11,391,067 B2
(45) Date of Patent: Jul. 19, 2022

(54) ELECTRONICALLY CONTROLLED PADLOCK

(71) Applicant: ASSA ABLOY AUSTRALIA PTY LIMITED, Oakleigh (AU)

(72) Inventors: Brendan George, Dingley (AU); Lydia Wong, Oakleigh (AU)

(73) Assignee: ASSA ABLOY AUSTRALIA PTY LIMITED, Oakleigh (AU)

( * ) Notice: Subject to any disclaimer, the term of this patent is extended or adjusted under 35 U.S.C. 154(b) by 478 days.

(21) Appl. No.: 16/500,020

(22) PCT Filed: Apr. 5, 2018

(86) PCT No.: PCT/AU2018/050314
§ 371 (c)(1),
(2) Date: Oct. 1, 2019

(87) PCT Pub. No.: WO2018/184070
PCT Pub. Date: Oct. 11, 2018

(65) Prior Publication Data

US 2020/0165841 A1 May 28, 2020

(30) Foreign Application Priority Data

Apr. 5, 2017 (AU) ..... 2017901246

(51) Int. Cl.

| | |
|---|---|
| ***E05B 47/06*** | (2006.01) |
| ***E05B 15/00*** | (2006.01) |
| ***E05B 47/00*** | (2006.01) |
| ***E05B 67/22*** | (2006.01) |
| ***G07C 9/00*** | (2020.01) |

(52) U.S. Cl.
CPC ..... *E05B 47/068* (2013.01); *E05B 15/0073* (2013.01); *E05B 47/0001* (2013.01); *E05B 67/22* (2013.01); *G07C 9/00309* (2013.01); *G07C 2009/00325* (2013.01)

(58) Field of Classification Search
CPC ..... E05B 47/068; E05B 15/0073; E05B 47/0001; E05B 67/22; E05B 47/0615; E05B 47/0012; G07C 9/00309; G07C 2009/00325
USPC ..... 340/5.7; 70/51
See application file for complete search history.

(56) References Cited

U.S. PATENT DOCUMENTS 3,742,739 A * 7/1973 Hickman ..... E05B 47/0042 70/276
3,779,052 A 12/1973 Deitch
3,857,262 A 12/1974 Sidiropoulos
(Continued)

FOREIGN PATENT DOCUMENTS

DE 102010021104 B3 10/2011
EP 2333204 B1 7/2013
(Continued)

*Primary Examiner* — Nam V Nguyen
(74) *Attorney, Agent, or Firm* — DeLio Peterson & Curcio LLC; Brian G. Schlosser

(57) ABSTRACT

This invention relates to a padlock assembly 1 including a body 2 with a hand engageable portion 4 that is external to the body 2 forming part of an actuator mechanism 5. The actuator mechanism 5 is electrically controllable to adjust between an operable condition and an inoperable condition to adjust a condition of a lock mechanism 31.

20 Claims, 13 Drawing Sheets

(56) References Cited

U.S. PATENT DOCUMENTS

| | | | | |
|---|---|---|---|---|
| 6,047,575 | A * | 4/2000 | Larson | G07C 1/32 70/38 A |
| 6,442,983 | B1 * | 9/2002 | Thomas | E05B 47/0012 70/278.1 |
| 6,761,051 | B1 * | 7/2004 | Tsai | E05B 47/0012 70/279.1 |
| 8,453,481 | B2 * | 6/2013 | Meekma | E05B 67/22 70/278.1 |
| 8,640,513 | B2 * | 2/2014 | Goren | E05B 47/0603 70/284 |
| 2006/0283216 | A1 * | 12/2006 | Marcelle | G07C 9/00182 70/38 A |
| 2010/0083713 | A1 | 4/2010 | Woodling | |
| 2014/0157838 | A1 * | 6/2014 | Nave | E05B 67/22 70/52 |

FOREIGN PATENT DOCUMENTS

| | | | |
|---|---|---|---|
| WO | 2009036585 | A1 | 3/2009 |
| WO | 2010105374 | A1 | 9/2010 |

* cited by examiner

FIG 11
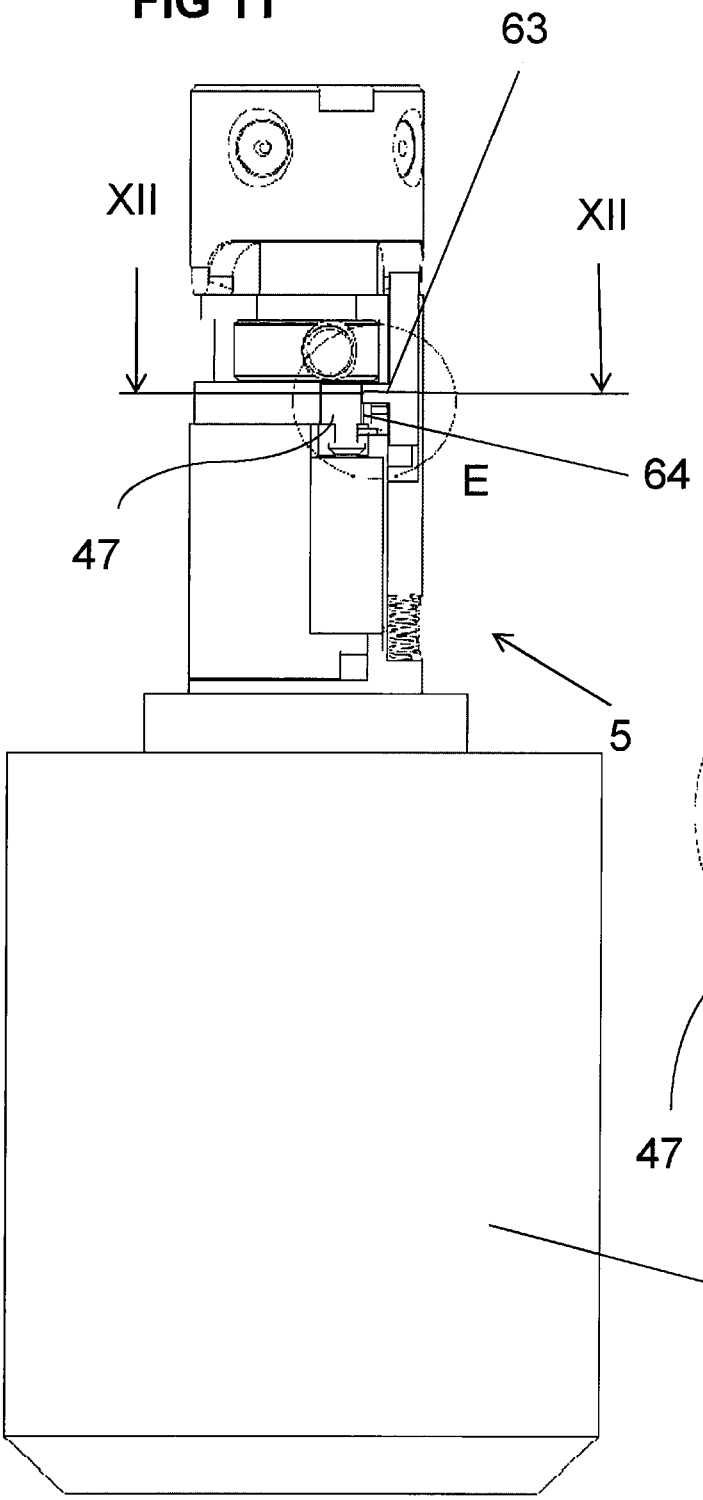
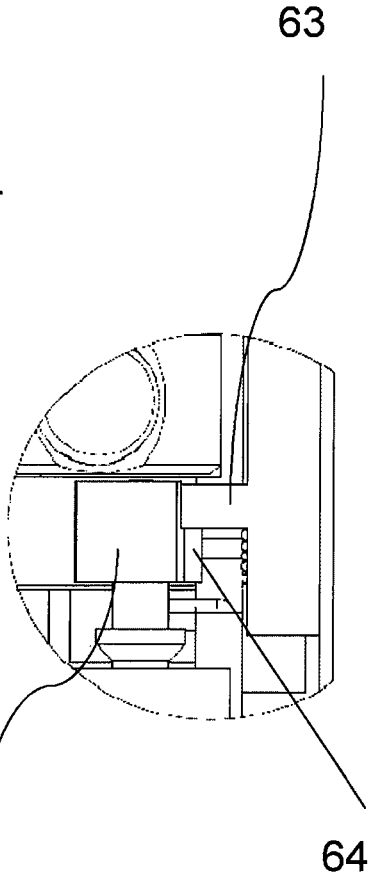
FIG 11E

ELECTRONICALLY CONTROLLED PADLOCK

BACKGROUND OF THE INVENTION

1. Field of the Invention

This invention relates to a padlock assembly including a body, a shackle movable relative to the body, a lock mechanism that can retain the shackle in a closed position and an electrically controlled actuator mechanism including a hand engageable portion that is external to the body for adjusting the condition of the lock mechanism.

2. Description of Related Art

Padlocks are used in a wide variety of applications including security applications such as lockers, gates and doors. A typical padlock will include a shackle and a body which houses a lock mechanism. A key will be inserted into a keyway of the lock mechanism to release the shackle allowing removal of the padlock from a hasp or other such portion of the locker, gate or door. One problem with typical padlocks is the keyway can be susceptible to vandalism by jamming foreign objects therein preventing normal operation of the padlock. Furthermore adjusting the keying of the padlock can be time consuming and not particularly cost effective if performed on the site of the locker, gate of door.

More recently padlocks have been designed to operate with an electronic keying system that interacts with an electrical lock mechanism within the body. Padlocks that use an electrical motor to adjust the lock mechanism acting directly on the retention of the shackle can use relatively large amounts of power to adjust the condition of the lock mechanism. This power usage impacts on their serviceable life between replacement of a power source. Whereas padlocks that utilise a smaller motor to act indirectly on the shackle will save on power, but will require some form of coupling that is often susceptible to manipulation from outside the body.

A reference herein to a patent document or other matter which is given as prior art is not to be taken as an admission that that document or matter was, in Australia, known or that the information it contains was part of the common general knowledge as at the priority date of any of the claims.

SUMMARY OF THE INVENTION

According to this invention there is provided a padlock assembly including a body, a shackle movable relative to the body between an open position and a closed position, a lock mechanism that when in an active condition can retain the shackle in the closed position and in an inactive condition can allow the shackle to move to the open position, an actuator mechanism including a hand engageable portion that is external to the body and is manually movable relative to the body, the actuator mechanism being electrically controlled to adjust between and operable condition and an inoperable condition, a coupling mechanism acting between the lock mechanism and the actuator mechanism, a first influencing arrangement that facilitates retaining the lock mechanism in the active condition, wherein when the actuator is in the operable condition movement of the hand engageable portion causes the condition of the lock mechanism to adjust from the active condition to the inactive condition.

The manner in which the first influencing arrangement functions to retain the lock mechanism in the active condition may take any suitable form. In a preferred form the coupling includes a drive member which is impeded from moving from a first position by the first influencing arrangement, however the drive member is movable from the first position when the actuator is operable. The first influencing arrangement may include any means for influencing or biasing the drive member includes at least one first magnet associated with the drive member urging the drive member to remain in the first position. It is further preferred that the first influencing arrangement includes at least one second magnet that is fixed relative to the body. The first influencing arrangement may also include at least one third magnet that is located between the at least one second magnet and the at least one first magnet when the drive member is in the first position. Where the at least one third magnet is included the at least one second magnet and the at least one third magnet can combine to attract the at least one first magnet. Alternatively the same magnetic force may be achieved by a stronger at least one second magnet only. A further alternative could include the at least one second magnet and the at least one third magnet combine to repel the at least one first magnet.

It is preferred that the at least one first magnet, the at least one second magnet and at least one third magnet each include four magnets equally spaced about an actuator axis about which the actuator rotates. Furthermore it is preferred that each of the first magnets, the second magnets and the third magnets are aligned and spaced radially from the actuator axis. However the number and location of each of the magnets may vary from this preferred configuration and could include the at least one first magnet, the at least one second magnet and at least one third magnet each include two magnets equally spaced about an actuator axis about which the actuator rotates. Furthermore, each of the second magnets and third magnets are aligned and spaced radially from the actuator axis, while the first magnets are radially spaced from the actuator axis and misaligned with the second magnets and third magnets when the drive member is in the first position.

The padlock assembly preferably includes a second influencing arrangement that facilitates retaining the hand engageable portion in a preferred position relative to the drive member. The actuator may take any form and in one form it includes a shaft that is locatable within the body, a distal end of the shaft being configured to accommodate the drive member. The second influencing arrangement preferably includes at least one fourth magnet associated with the shaft of the actuator. It is further preferred that the drive member includes a head portion and the second influencing arrangement includes at least one fifth magnet associated with the head portion of the drive member. It is still further preferred that the at least one fourth magnet is repulsed by the at least one fifth magnet. Alternatively, the actuator includes a shaft that is locatable within the body, a distal end of the shaft being configured to interact with the drive member. The second influencing arrangement includes at least one fourth magnet associated with the shaft of the actuator. The second influencing arrangement includes at least one fifth magnet associated with the drive member. The at least one fourth magnet is attracted to the at least one fifth magnet. The at least one fourth magnet and at least one fifth magnet may each include two magnets spaced about the actuator axis, however this may vary. Alternatively, the at least one fourth magnet include two magnets spaced about the actuator axis and the at least one fifth magnet include four magnets spaced about the actuator axis. It is further preferred that each of the two fourth magnets and two fifth magnets are on opposed sides of the actuator axis.

The distal end of the shaft may be configured to capture the head of the drive member so as to be rotatable relative thereto.

The lock mechanism may take any suitable form, and in one preferred form includes a cam having at least one cam surface, and at least one detent to interact with the at least one cam surface, and the shackle is configured with at least one recess for receiving the at least one detent when the shackle is in the closed position and the lock mechanism is in the active condition. The number of recesses in the shackle, detents and cam surfaces may clearly vary. The lock mechanism may include a biasing arrangement for biasing on the cam. The preferred form of biasing arrangement includes a spring and an abutment plate, one end of the spring acting on the cam and another end of the spring acting on the abutment plate, whereby the abutment plate is fixed from rotating about the actuator axis to bias on the cam when the when the lock mechanism is in the inactive condition. Clearly other forms of biasing arrangement are possible.

The coupling may take any suitable form and in one form includes a driven member that has a distal side configured to drivingly engage with the cam so that rotation of the driven member causes rotation of the cam against the action of the spring. It is further preferred that the driven member includes a proximal side configured to drivingly engage with the drive member so that rotation of the drive member causes rotation of the driven member. Alternatively, the drive member includes a distal side configured to drivingly engage with the cam so that rotation of the driven member causes rotation of the cam against the action of the spring.

The actuator preferably includes an interlocking mechanism that is electrically controlled so that the actuator is adjustable between an operable condition and an inoperable condition. The interlocking arrangement may take any suitable form and in a preferred form includes a catch movable between an extended position and a retracted position with the actuator adopting the operable condition when the catch is in the extended position. It is preferred that the interlocking arrangement includes a biasing member for biasing the catch towards the extended position and a selectively operable blocking mechanism for blocking the catch from moving towards the retracted position. It is further preferred that the selectively operable blocking mechanism includes a blocking member and an electrical adjuster which adjusts the orientation of the blocking member relative to the catch between a blocked position and an un-blocked position. Alternatively, the interlocking arrangement includes an electrical adjuster that is operable to move a movable member between an extended position and a retracted position whereby the actuator adopts the operable condition when the movable member is in the extended position and the movable member interacts with a recess in the coupling when it is in the extended position. It is further preferred that the padlock assembly include an electronic authorisation arrangement for receiving and processing a signal from an authorisation key, and controlling operation of the electrical adjuster on receipt of an authorised key.

BRIEF DESCRIPTION OF THE DRAWINGS

It will be convenient to hereinafter describe a preferred embodiment of the padlock according to the invention. The particularity of the illustrations and the associated detailed description is merely illustrative of one embodiment of the invention and is not intended to be limiting on the scope of the claims.

FIG. 11 is a cross-sectional view through XI from FIG. 10.

FIG. 11E is a detailed view of area E from FIG. 11.

DESCRIPTION OF THE PREFERRED EMBODIMENT(S)

Figure 1:
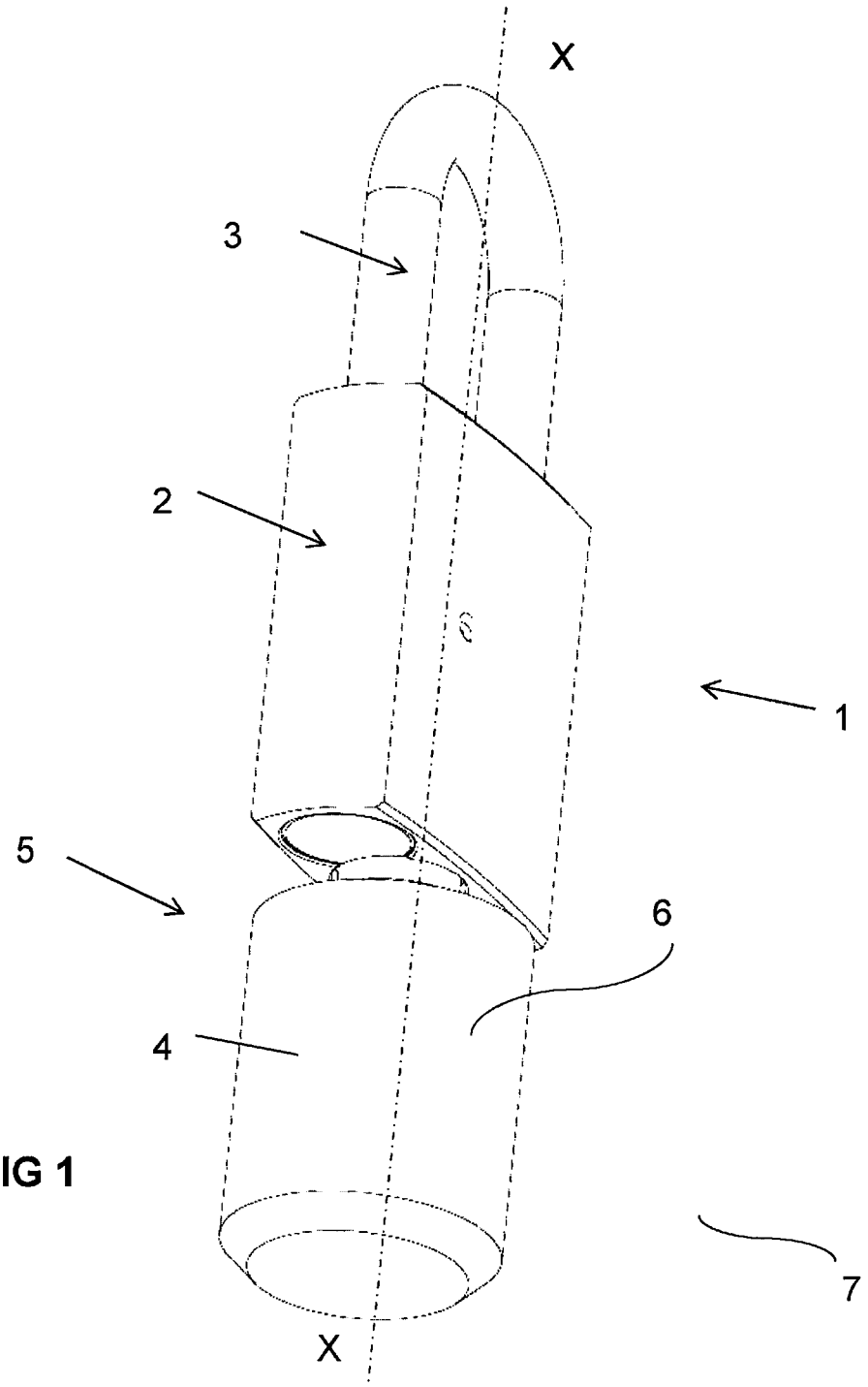
FIG. 1 illustrates an isometric view of a preferred embodiment of the padlock.

Referring to FIG. 1 there is shown a preferred embodiment of a padlock assembly 1 including a body 2 and shackle 3. The shackle 3 is movable relative to the body 2 between a closed position as illustrated in FIG. 1 and an open position (see FIG. 5) so as to allow for the padlock to be attached to a hasp (not shown) or other such facility. FIG. 1 also illustrates a hand engageable portion 4 in the form of a knob forming part of an actuator mechanism 5, the hand engageable portion 4 can be rotated about an actuator axis X-X in order that a shackle 3 can be released to move to the open position. However in order to provide the padlock assembly 1 with some form of security the actuator 5 is adjustable between an operable condition and an inoperable condition in a manner that will be described in greater detail by reference to latter illustrations. However it is preferred that the padlock assembly 1, and in particular the actuator 5 house some form of electronic authorisation means 6 such as a microprocessor, control electronics and antennae for interacting with some form of proximity security card 7 or other RFID security device to limit operation of the actuator to authorised users only.

Figure 2:
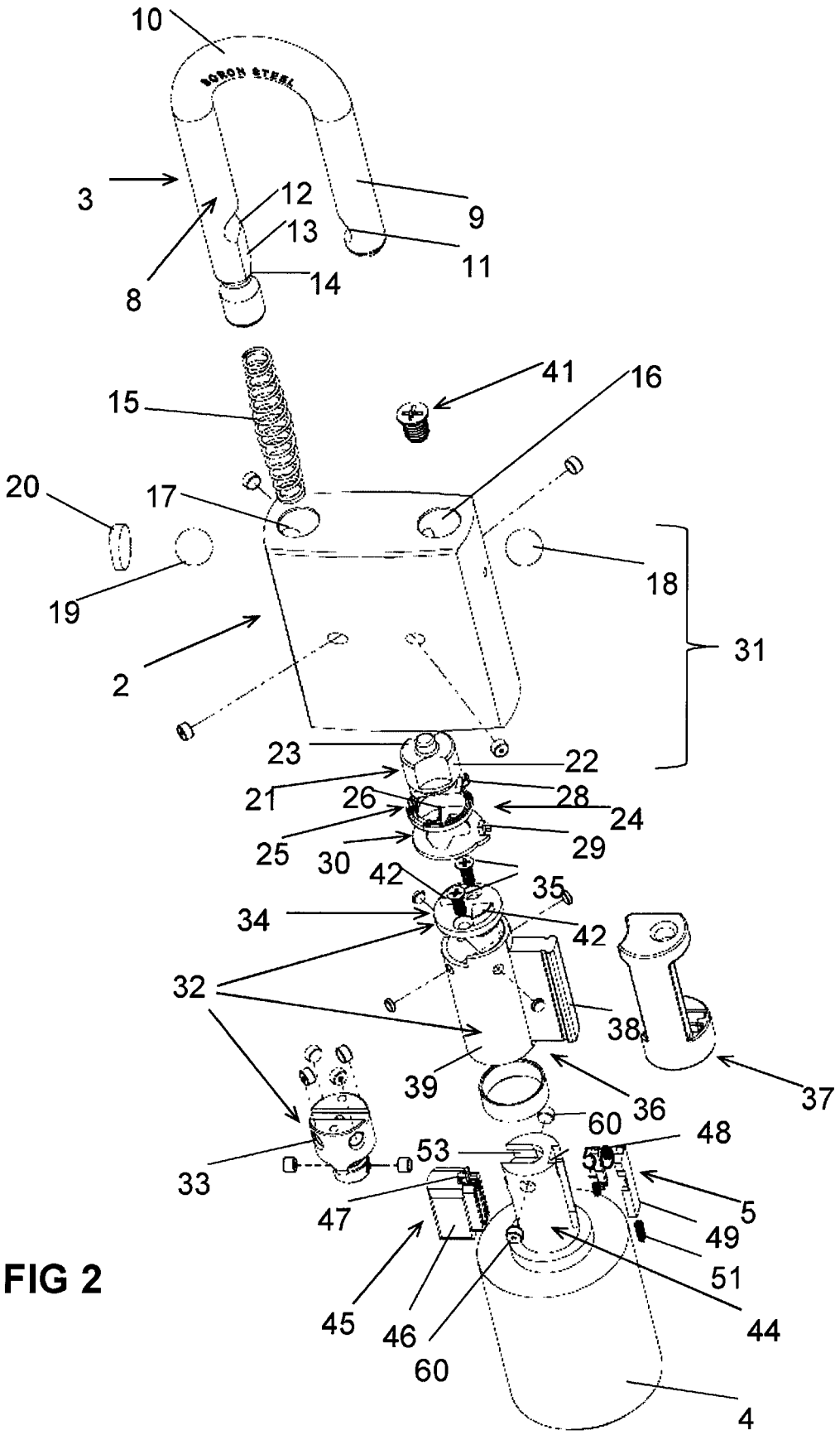
FIG. 2 is an exploded isometric view of the padlock from FIG. 1 from one perspective.

Referring now to FIG. 2 which illustrates a substantially U-shaped shackle 3 with a relatively long leg 8 and a relatively short leg 9 spaced apart by a curved portion 10. Both the long leg 8 and short leg 9 each include a relatively deep recess 12, 11 formed therein at a position spaced from the curved portion 10. The long leg 8 also includes a planar surface 13 adjacent the deep recess 12 extending towards a free end of the long leg 8 and terminating in a relatively shallow annular recess 14. A compression spring 15 is also provided to act in between the long leg 8 of the shackle 3 and the body 2 for urging the shackle 3 towards the open position. The body 2 includes a pair of spaced apertures 16, 17 with the lower of the two apertures 17 configured to accommodate the shackle spring 15 and the long leg 8, whilst the upper aperture 16 is configured to accommodate a portion of the short leg 9 when the shackle 3 is in a closed position (see FIG. 4).

Referring again to FIG. 2 there is shown two ball detents 18, 19 which form part of a lock mechanism 31, and are configured to interact with the recesses 12, 11 in the long leg 8 and short leg 9 when the shackle 3 is in the closed position. The balls 18, 19 are inserted into the body 2 through an aperture (not shown) in a lower wall (not shown) in the body 2. The aperture in the lower wall is then permanently closed with a cap 20 in a manner that will be appreciated by those skilled in the art.

Referring again to FIG. 2 there is shown a cam member 21 having a pair of cam surfaces 22, 23 formed on opposed sides of the cam member 21. Each cam surface 22, 23 is configured in order to control radial movement of each respective ball detent 18, 19 relative to the actuator axis X-X on rotation of the cam 21 about the actuator axis X-X. Whilst each cam surface 22, 23 illustrated in FIG. 2 is in the shape of combined crescent shapes, the cam surface 22, 23 may have different shape to that as illustrated in FIG. 2 and yet still achieve the same function.

The lock mechanism 31 illustrated in FIG. 2 also includes a biasing arrangement 24 for biasing the cam 21 to urge the lock mechanism 31 to adopt an active condition. The biasing arrangement 24 includes a torsion spring 25 having an inner end 26 that locates in a groove 27 (see FIG. 3) formed in a proximal surface of the cam 21. An outer end 28 of the torsion spring 25 is formed as a hook which locates about a lug 29 on an abutment plate 30. The abutment plate 30 is fixed from movement about the actuator axis X-X by snugly locating within a figure of eight bore 40 (see FIG. 3) in the body 2. Tension can be applied to the torsion spring 25 when the cam 22 is rotated causing the lock mechanism 31 to adjust from the active condition.

Referring again to FIG. 2 there is shown a coupling mechanism 32 acting between the lock mechanism 31 and the actuator mechanism 5. The coupling mechanism includes a drive member 33 and a driven member 34 whereby the drive member 33 is attached to the driven member 34 by a pair of screws 35. The distal surface of the drive member 33, and proximal surface of the driven member 34 (partially obscured in FIG. 3) are configured to drivingly mate with one another so as to facilitate transfer of torque through the drive member 33 to the driven member 34 in addition to the screw fastener 35 attachment. Whilst the preferred configuration involves some form of tongue and groove arrangement, other configurations to drivingly mate are clearly possible. The coupling mechanism 32 also includes a coupling housing assembly, which in the embodiment illustrated includes a base 36 and a cap 37. The base illustrated is in the form of a relatively standard cylinder lock housing with a bible portion 38 extending from a barrel portion 39. The bible portion 38 is located within the cap 37, and the whole coupling housing inserted in a figure of eight bore 40 (see FIG. 3) in the body 2. A screw 41 is then used to fasten the coupling housing, or more specifically the cap 37 to the body 2 so as to fasten the housing within the body 2. Clearly the shape of the coupling housing may vary from that as illustrated in FIG. 2.

Figure 3:
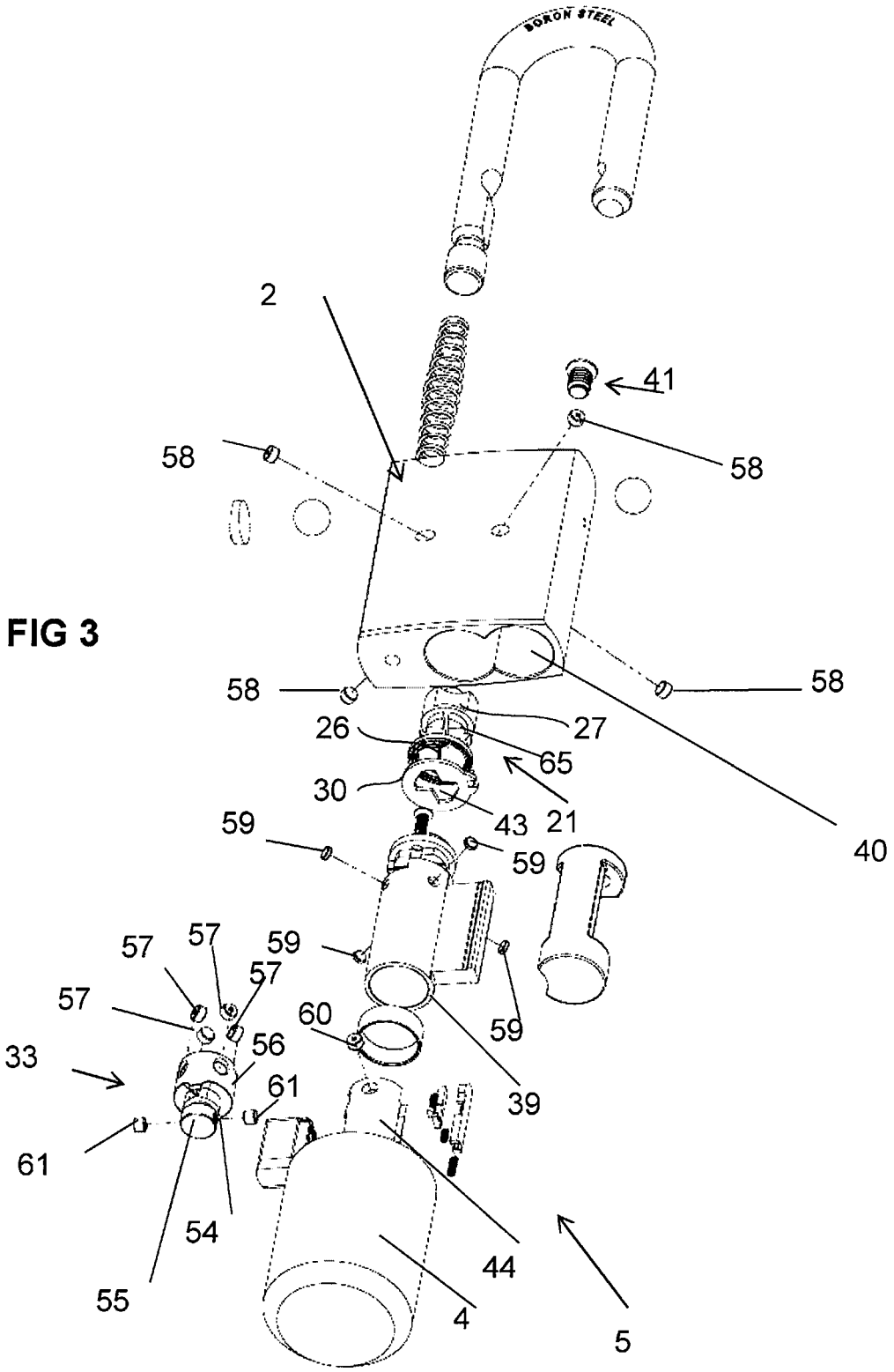
FIG. 3 is an exploded isometric view of the padlock from FIG. 1 from an opposite perspective.

Referring again to FIG. 2 which shows a distal surface of the driven member 34 configured to drivingly interact with a proximal surface of the cam 21 (see FIG. 3). Specifically the distal surface of the driven member includes a pair of radially spaced wedge portions 42 which locate on opposed sides of a vertical flange 65. When assembled the flange 65 extends through the center of the torsion spring 25 and a complementary shaped aperture 43 (see FIG. 3) formed in the abutment plate 30. The respective shapes of the aperture 43 and the flange 65 limits movement of the cam to no more than 90. Clearly however the shape of the aperture 43, flange 65 and the wedges 42 may vary from that as illustrated in FIGS. 2 and 3.

Figure 13:
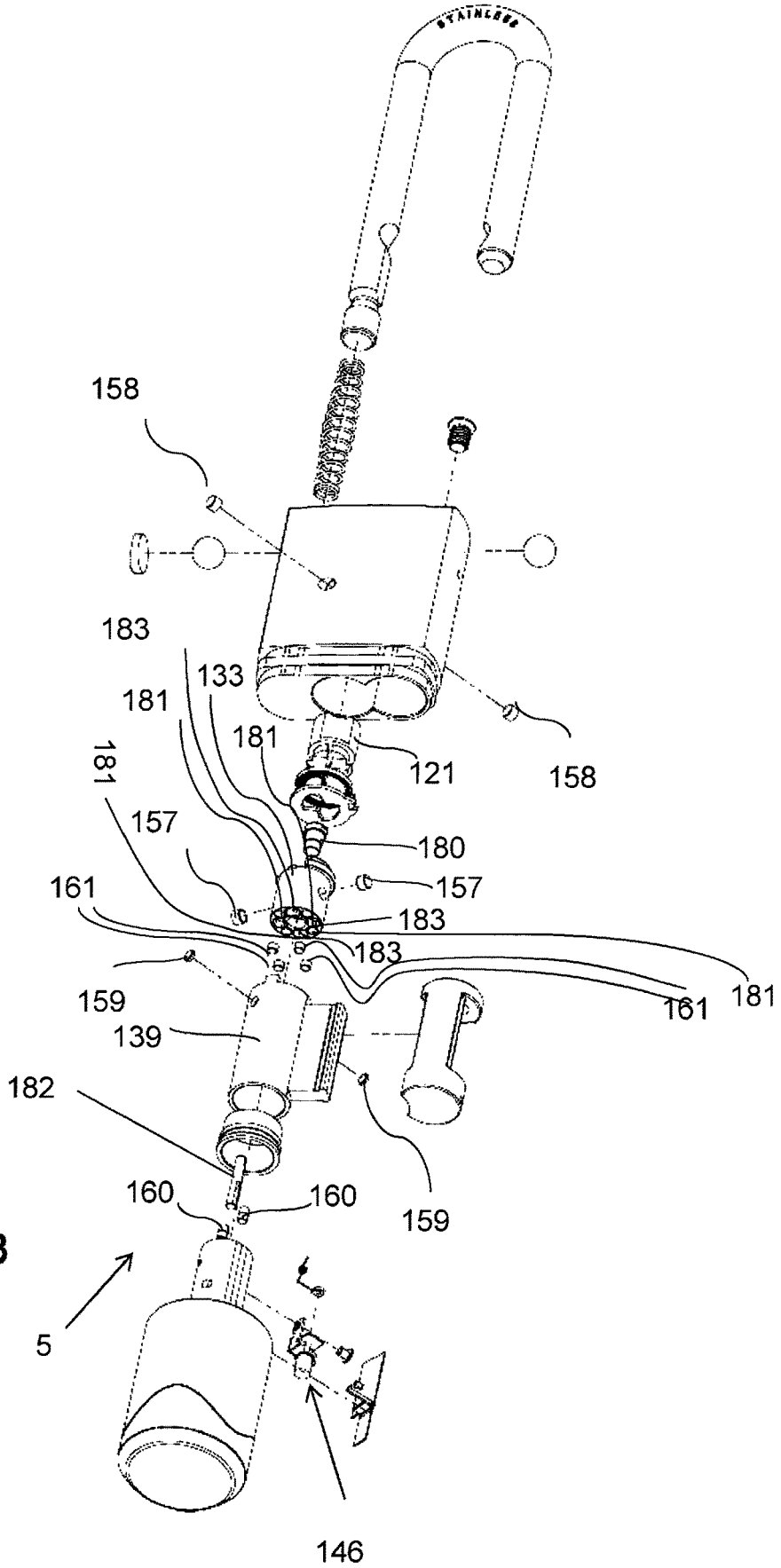
FIG. 13 is an exploded isometric view of an alternate embodiment of the padlock from FIG. 1.

Referring again to FIG. 2 which shows the actuator including a shaft 44 extending from the hand engageable portion 4. The shaft 44 is shaped to locate within the barrel 39, and to rotate there within on manual rotation of the hand engageable portion 4 by an authorised user. The actuator 5 also includes a blocking mechanism 45 having an electrical adjuster 46 with a blocking member 47 which is located within a recess formed in an underside of the shaft 44. The electrical adjuster 46 and blocking member 47 form part of an interlocking mechanism, the operation of which is controlled by the electronic authorisation means 6. The interlocking mechanism also includes a catch 48, and a cover 49, both of which are biased towards an extended position and are locatable within a groove 50 formed in an upper surface of the shaft 44. FIG. 2 illustrates a number of compression springs 52, 51 for independently biasing the catch and cover 48 towards the extended position. The catch 48 is configured to interact with the drive member 33 in a manner which will be described in greater detail with reference to latter illustrations. Alternatively, the drive member and driven member may be replaced by a single drive member 133 as illustrated in FIG. 13.

Referring again to FIG. 2 which shows a radial extending slot 53 formed in a distal end of the shaft 44. The radial slot is configured to accommodate a neck portion 54 (see FIG. 3) of the drive member 33 which extends between a head portion 55 and a body portion 56 of the drive member 33. This configuration allows for rotation of the drive member 33 relative to the actuator 5, whilst preventing axial movement of the actuator 5 relative to the drive member 33 when the padlock assembly 1 is assembled. Alternatively, as illustrated in FIG. 13 the distal end of the shaft 44 may be attached to the single drive member 133 by way of a screw 180. This alternate arrangement still allows for rotation of the single drive member 133 relative to the actuator 5.

It is an aspect of the invention that the padlock assembly include a first influencing arrangement that facilitates retaining the lock mechanism 31 in the active condition. This may be achieved in any suitable arrangement, and in the embodiment illustrated in FIG. 3, the first influencing arrangement preferably includes four first magnets 57 with the body 56 of the drive member 33, four second magnets 58 fixed to the body 2, and four third magnets 59 fixed to the barrel. The number and location of the magnets 57, 58, 59 may vary from that as illustrated in FIGS. 2 and 3, and in the broadest embodiment of the invention the first influencing arrangement may include only one first magnet 57, one second magnet 58 and only one third magnet 59. While in the alternate embodiment illustrated in FIG. 13 the first influencing arrangement includes two first magnets 157, two second magnets 158 and two third magnets 159.

The preferred arrangement illustrated in FIGS. 2 and 3 the magnetic force produced by the second magnets 58 and the third magnets 59 combine to attract the magnetic force produced by the first magnets 57. While in the alternate embodiment illustrated in FIG. 13 the magnetic force produced by the second magnets 158 and third magnets 159 combine to repel the first magnets 157. Both of these embodiments facilitate retaining the drive member 33, 133 absent any other external forces, in a first position relative to the body 2, 102. Furthermore, provided that the orientation of the cam 21, 121 relative to the drive member 33, 133 is as shown in for example FIG. 4, it will result in the influencing arrangement facilitate retaining the lock mechanism 31 in the active condition.

Referring again to FIG. 3 which illustrates a second influencing arrangement acting between the actuator 5 and the drive member 33. Once the first influencing arrangement has oriented the drive member 33 to its first position, the second influencing arrangement, in the absence of external forces to the contrary, facilitates adjusting the hand engageable portion 4 towards a preferred position relative to the drive member 33. The second influencing arrangement illustrated in FIG. 3 includes a pair of fourth magnets 60 (see also FIG. 2) associated with the shaft 44, and a pair of fifth magnets 61 associated with the head portion 55 of the drive member 33. The magnetic forces of the fourth magnets 60 and fifth magnets 61 are repulsive so as to rotate hand engageable portion 4 relative to the drive member 33. Clearly the number and orientation of the fourth magnets 60 and fifth magnets 61 may vary from that as illustrated in FIG. 2, and in the broadest embodiment includes only one fourth magnet 60 and one fifth magnet 61. Furthermore the magnetic forces of the fourth magnets 60 and fifth magnets 61 may be attractive, however their relative positions would need to change. The alternate embodiment illustrated in FIG. 13 includes two fourth magnets 160 on the distal end of the shaft 144, and four fifth magnets 161 for location in recesses 181 in the single drive member 133. In this alternate embodiment the magnetic forces of the fourth magnets 160 and fifth magnets 161 are attractive.

Figure 4:
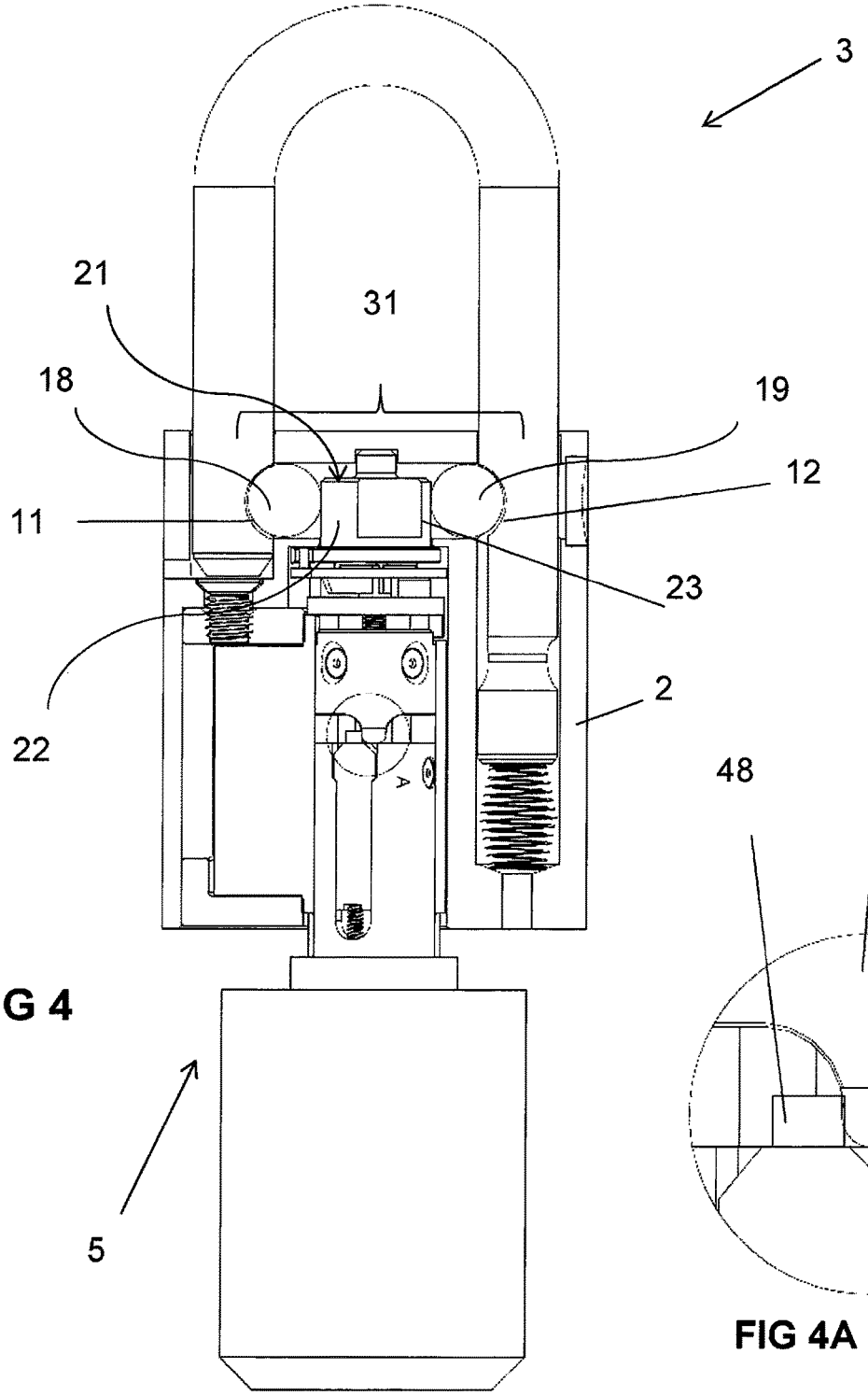
FIG. 4 is a cross-sectional view of the padlock from FIG. 1 with the lock mechanism in an active condition, and the actuator in an operable condition.

Referring now to FIG. 4 which shows the shackle 3 in a closed position, and the lock mechanism 31 in an active condition. When the lock mechanism 31 is in this active condition the rotational position of the cam 21 relative to the ball detents 18, 19 is one such that the cam surfaces 22, 23 on the cam 21 are urging the ball detents 18, 19 to move radially relative to the actuator axis, to locate within the larger recesses 12, 11 formed in the long and short legs 8, 9 of the shackle 3. While the cam 21 remains in the position illustrated in FIG. 4, movement of the shackle 3 relative to the body 2 is prevented. In order to allow the shackle 3 to move to an open position, the lock mechanism 31 must be adjusted to an inactive condition.

Figure 4A:
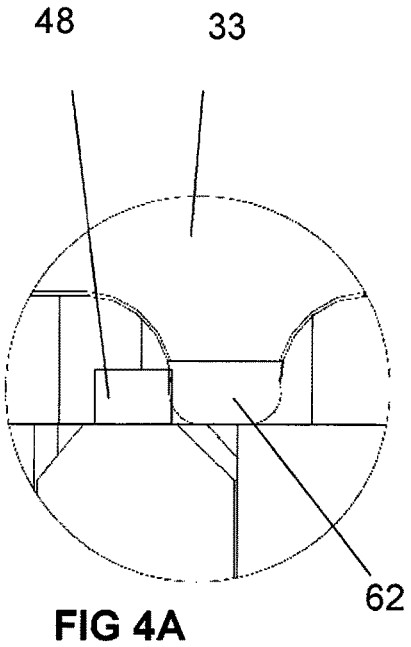
FIG. 4A is an exploded view of area A from FIG. 4.
Figure 5:
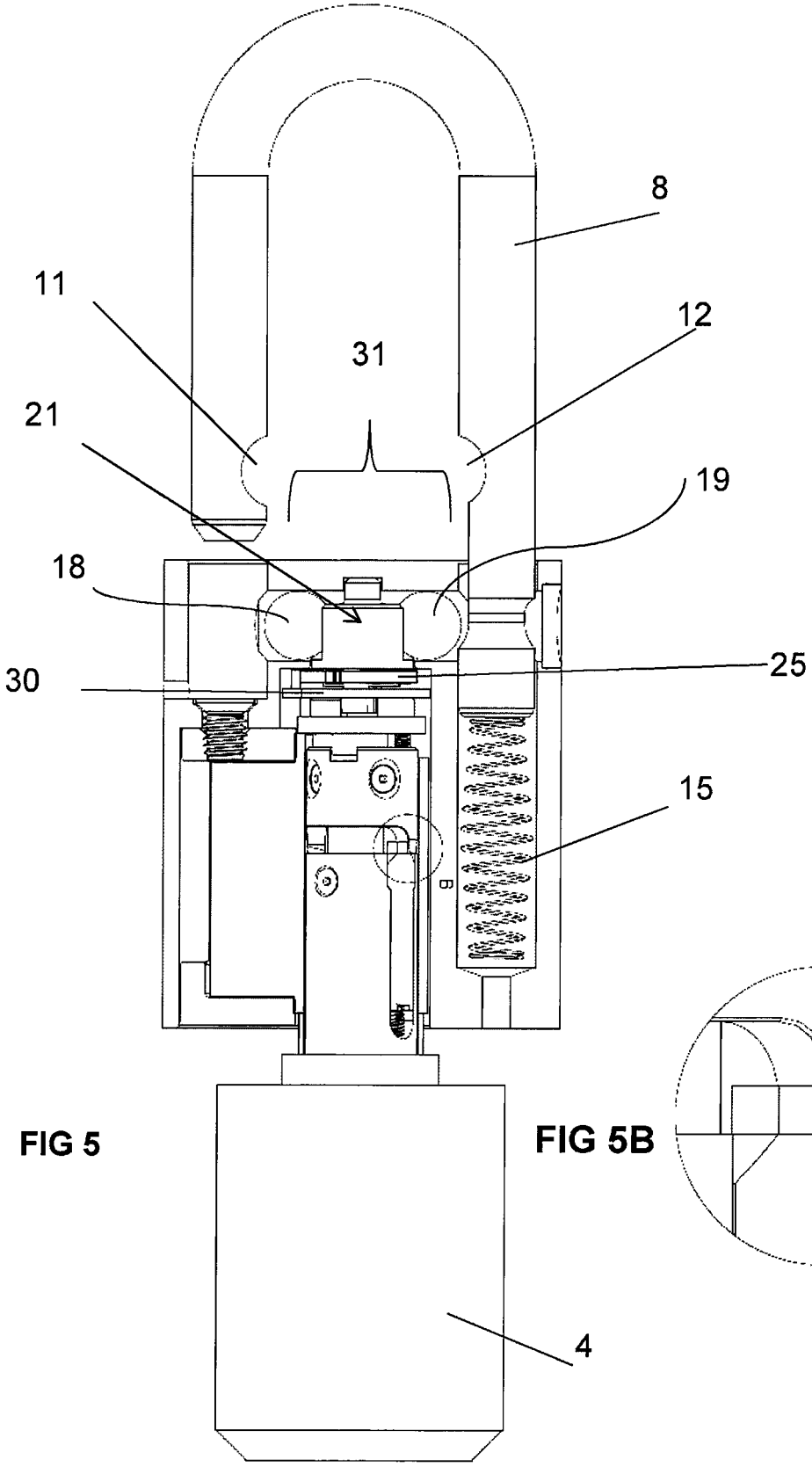
FIG. 5 is the cross-sectional view of the lock assembly shown in FIG. 4 with the lock mechanism in an inactive condition, the shackle in an open position.
Figure 5B:
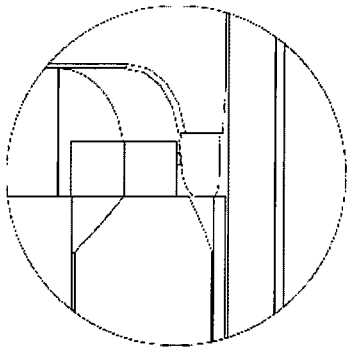
FIG. 5B is a detailed view of area B from FIG. 5.

FIG. 4 illustrates the actuator 5 in an operable condition, and in particular FIG. 4A illustrates the catch 48 in an extended position whereby it rotationally overlaps with a flange 62 formed on the drive member 33. With the catch 48 in this extended position, rotation of the hand engageable portion 4 from the position illustrated in FIG. 4, to the position illustrated in FIG. 5 will result in rotation of the cam 21 so as to allow the lock mechanism 31 to adopt an inactive condition. This allows the ball detent 18, 19 to retract radially inwardly from the recesses 11, 12 formed in the long leg and short leg 8, 9 of the shackle 3. The compression spring 15 acting on the shackle 3 then causes the shackle 3 to move relative to the body 2 to adopt and open position. Once the user has ceased applying a rotational force to the hand engageable portion 4, the drive member 33 and actuator 5 will return to the first position and preferred position respectively under the influence of the first influencing arrangement and second influencing arrangements. However the cam member 21 will be retained in the position as illustrated in FIG. 5, notwithstanding biasing force produced by the torsion spring 25 acting on the cam 21 urging the lock mechanism 31 to return to the active condition. The cam 21 will be prevented from rotating by the ball detent 19 acting between the long leg 8 of the shackle 3 and the cam 21, until such time as the shackle 3 is returned to the closed position. Once the shackle 3 is returned to the closed position, the cam 21 can rotate under the influence of the torsion spring 25 to return to the position as illustrated in FIG. 4.

Figure 6:
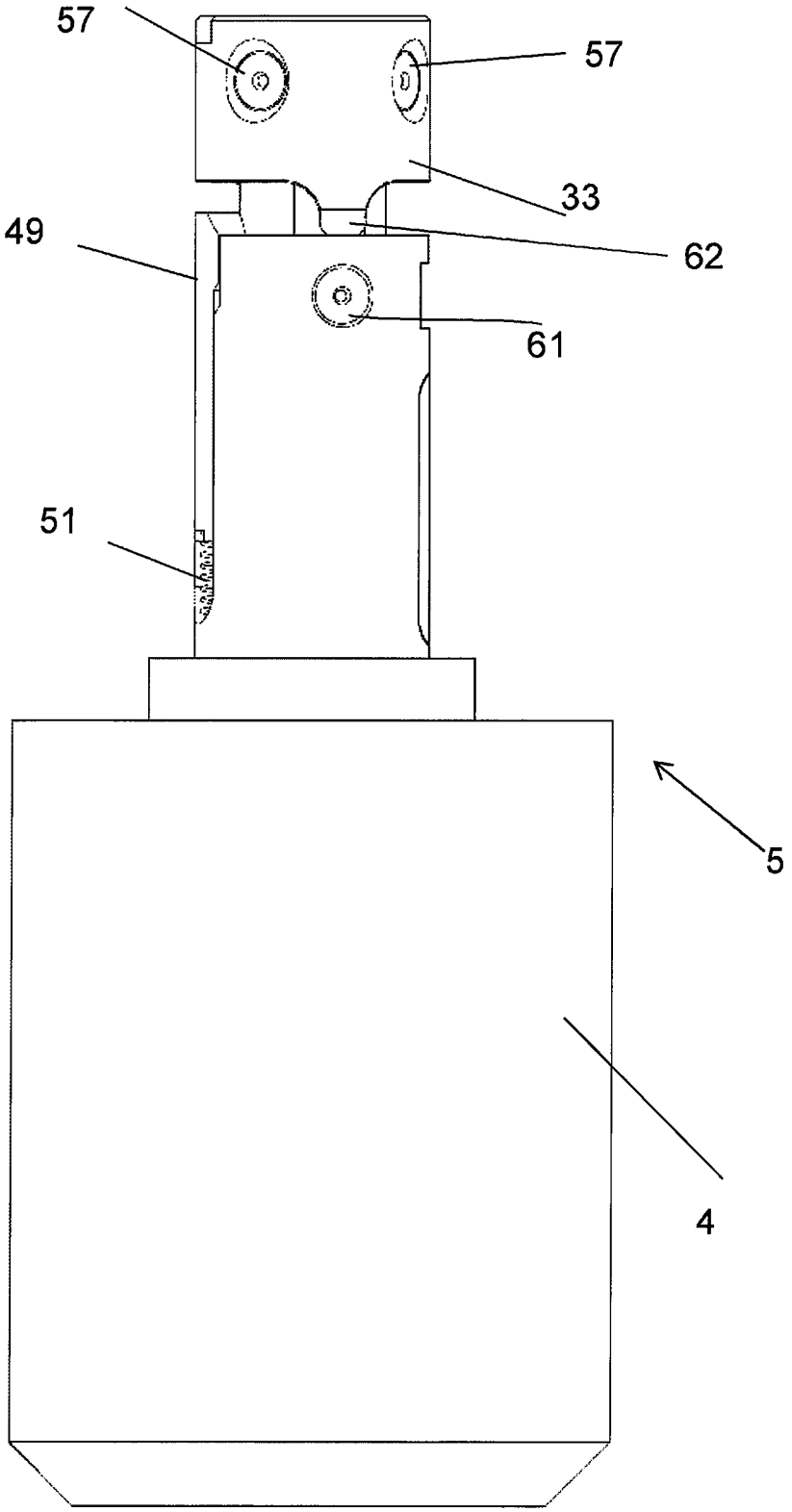
FIG. 6 is a side elevation view of the drive member and actuator, with the actuator being in an inactive condition.
Figure 7:
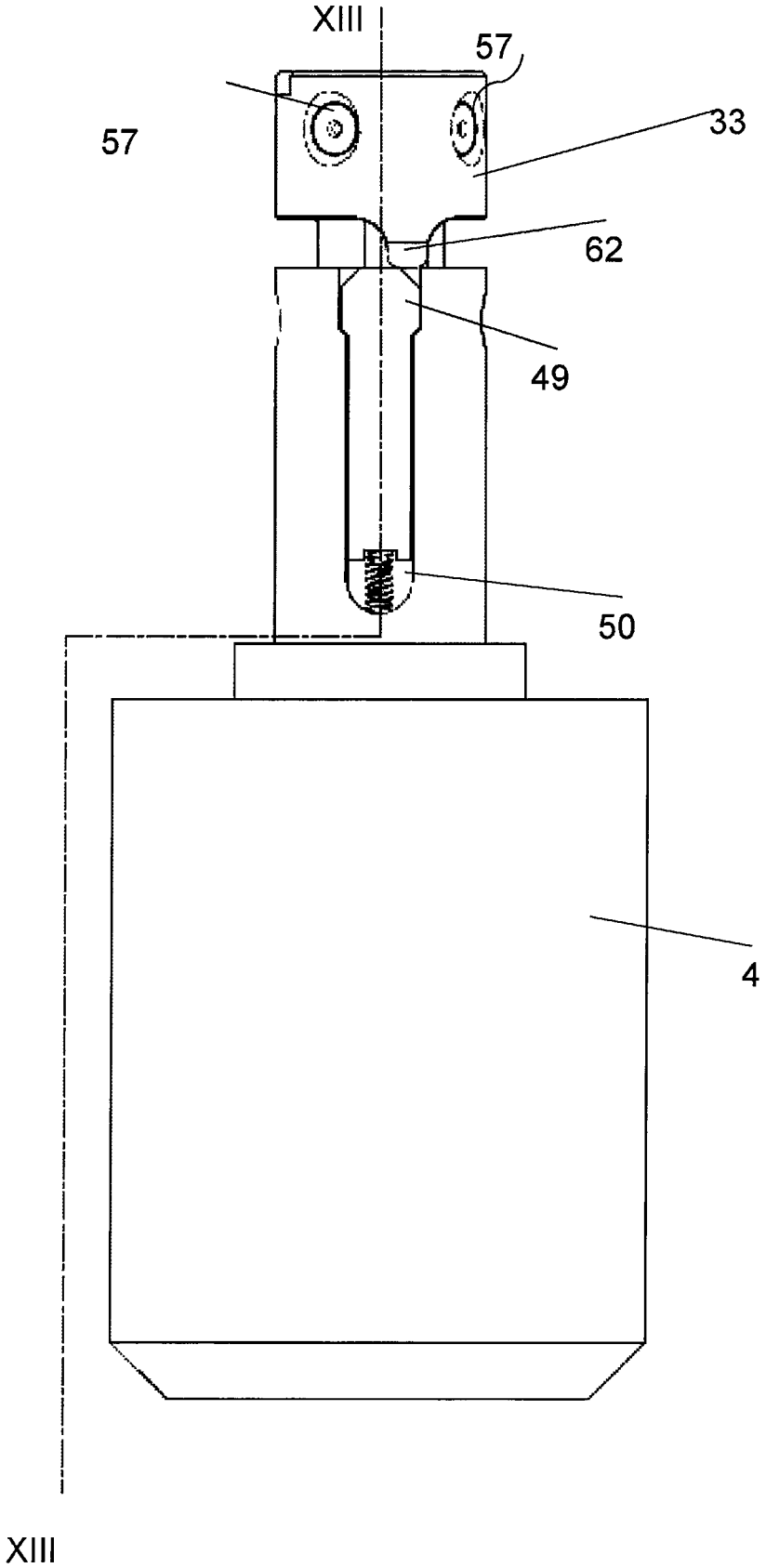
FIG. 7 is a side elevation view of the actuator and drive member with the actuator rotating relative to the drive member from the position illustrated in FIG. 6.
Figure 8:
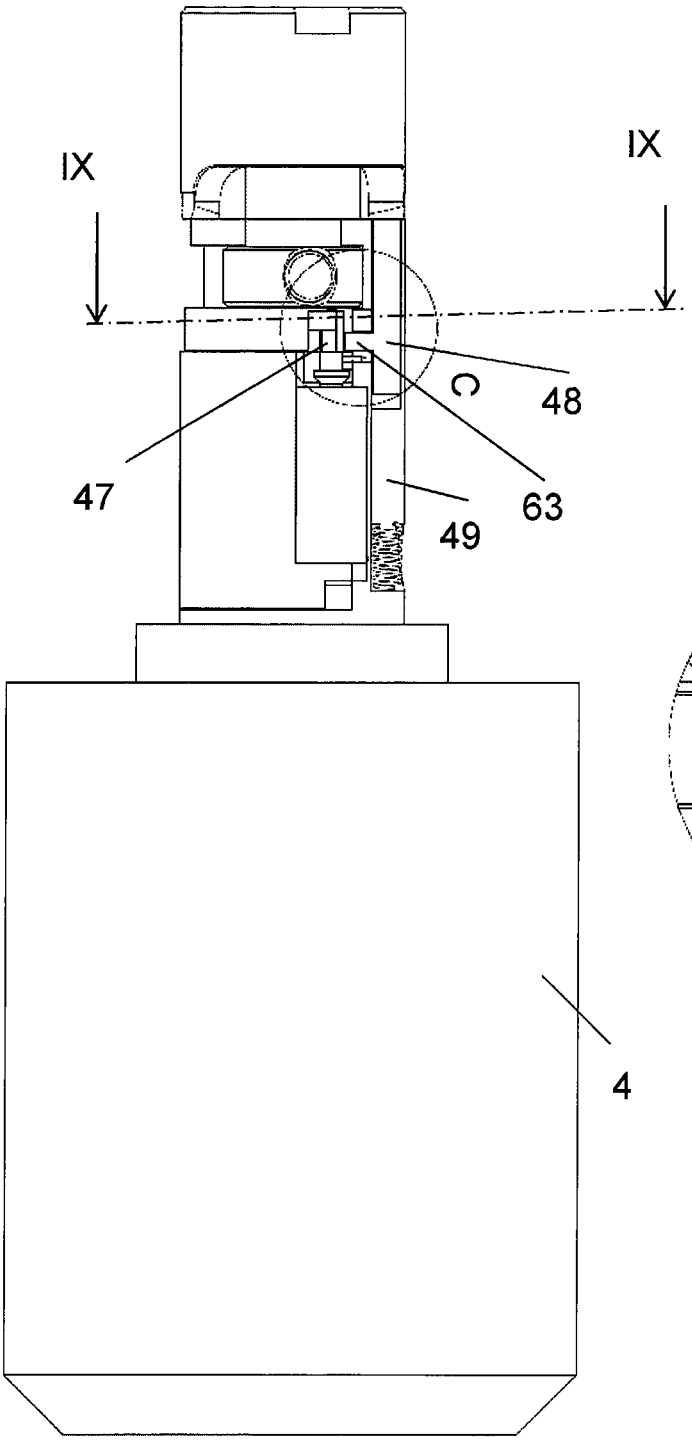
FIG. 8 is a cross-sectional view through the actuator and drive member through XIII of FIG. 7.
Figure 8C:
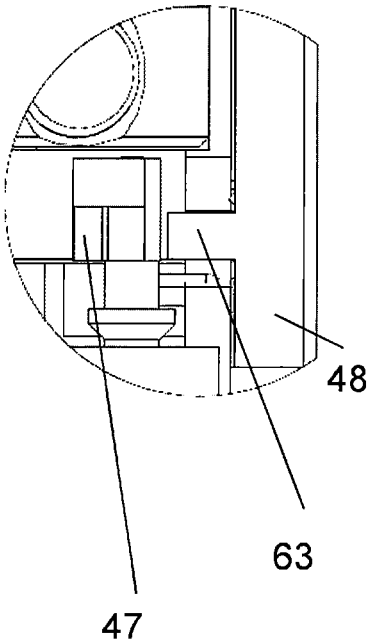
FIG. 8C is a detailed view of the area C from FIG. 8.

The adjustment of the actuator 5 between an operable condition and inoperable condition will now be described in greater detail with reference to FIGS. 6 to 12F. FIG. 6 illustrates the drive member 33 in a first position, and the hand engageable portion 4 of the actuator 5 in a preferred position relative to the drive member 33, each under the influence of the first influencing arrangement and second influencing arrangements respectively. FIG. 6 also illustrates the cover 49 of the interlocking arrangement in an extended position under the influence of its spring 51. In contrast FIG. 7 illustrates the hand engageable portion 4 having been rotated from its preferred position. While the actuator 5 is in the inoperable condition, as illustrated in FIGS. 7 to 9D, rotation of the hand engageable portion 4 will result in a distal end of the cover 49 gliding over the flange 62 of the drive member 33 whilst retracting into the end of the slot. This will permit relative rotation of the hand engageable portion 4 relative to the drive member 33. Referring now to FIG. 8 we can appreciate that retraction of the cover 49, also results in retraction of the catch 48 away from the extended position, and a lower leg 63 of the catch 48 is free to move relative to the blocking member 47 which can be more clearly appreciated from FIG. 8C. Furthermore it can be appreciated from FIGS. 9 and 9D that the blocking member 47 includes a shoulder 64 that is spaced from the lower leg 63 of the catch 48 when the actuator 5 is in the inoperable condition.

Figure 9:
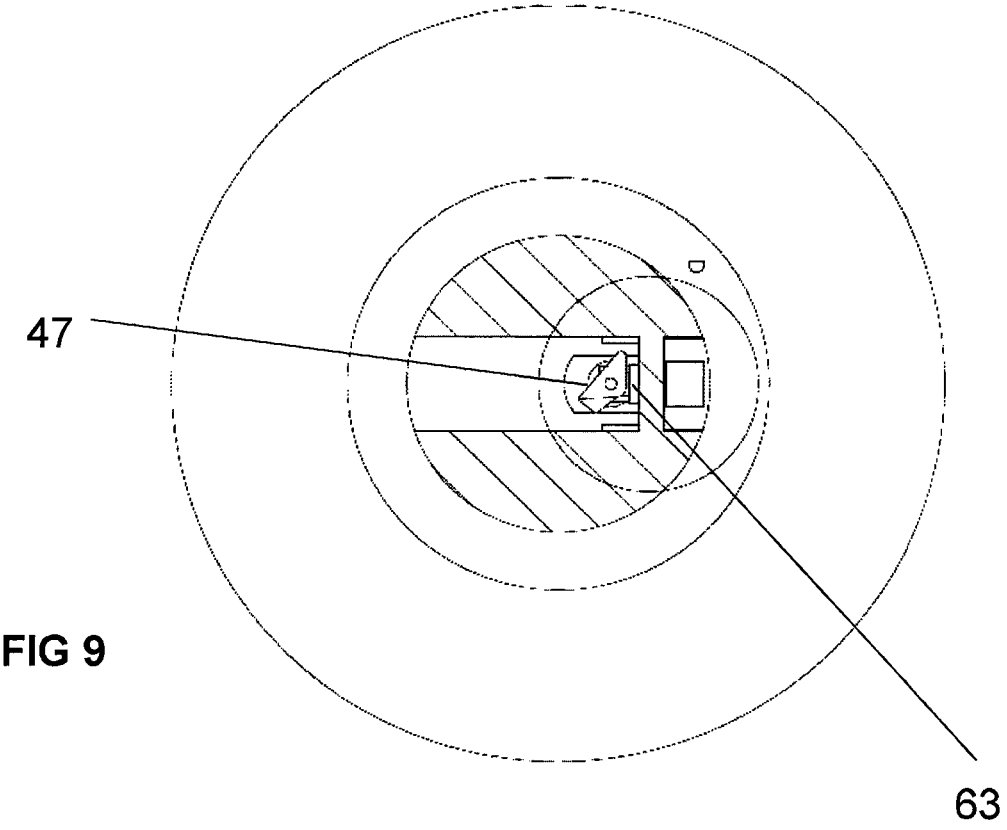
FIG. 9 is a cross-sectional view through IX from FIG. 8.
Figure 9D:
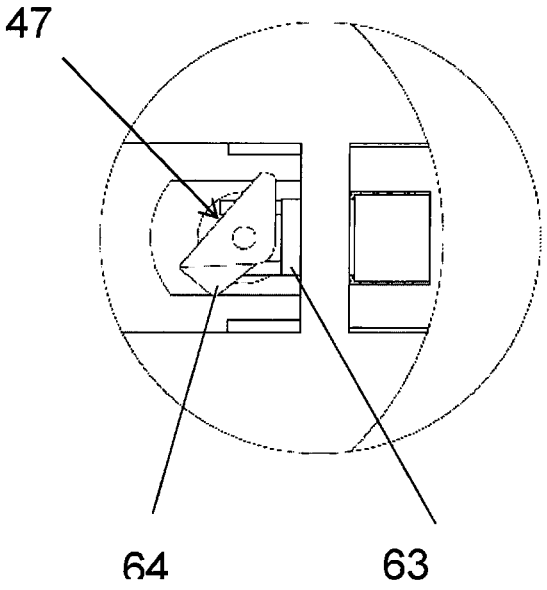
FIG. 9D is a detailed view of the area D from FIG. 9.
Figure 10:
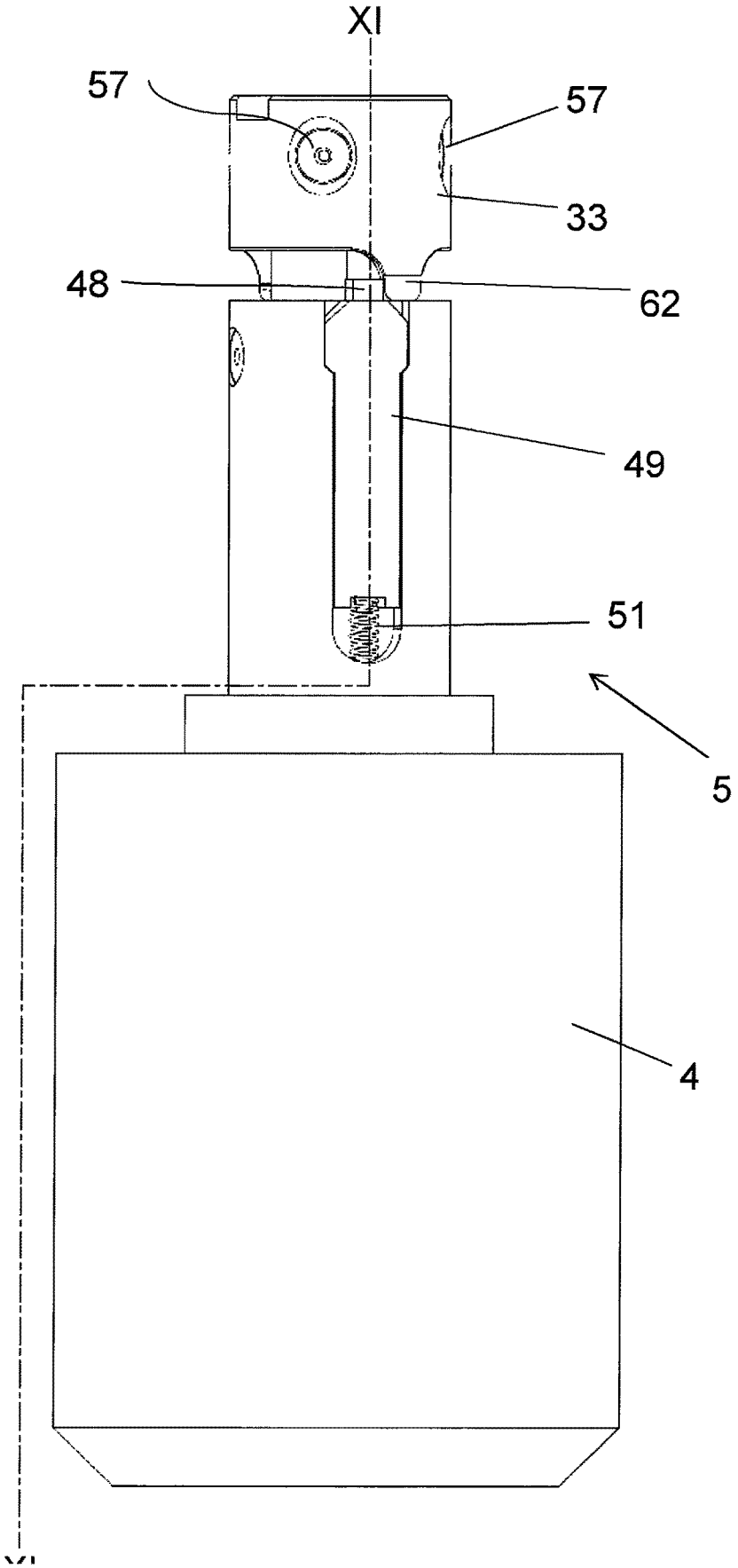
FIG. 10 is a side elevation view of the actuator and drive member with the actuator in the operable condition and the drive member rotated from the position illustrated in FIG. 6.
Figure 12:
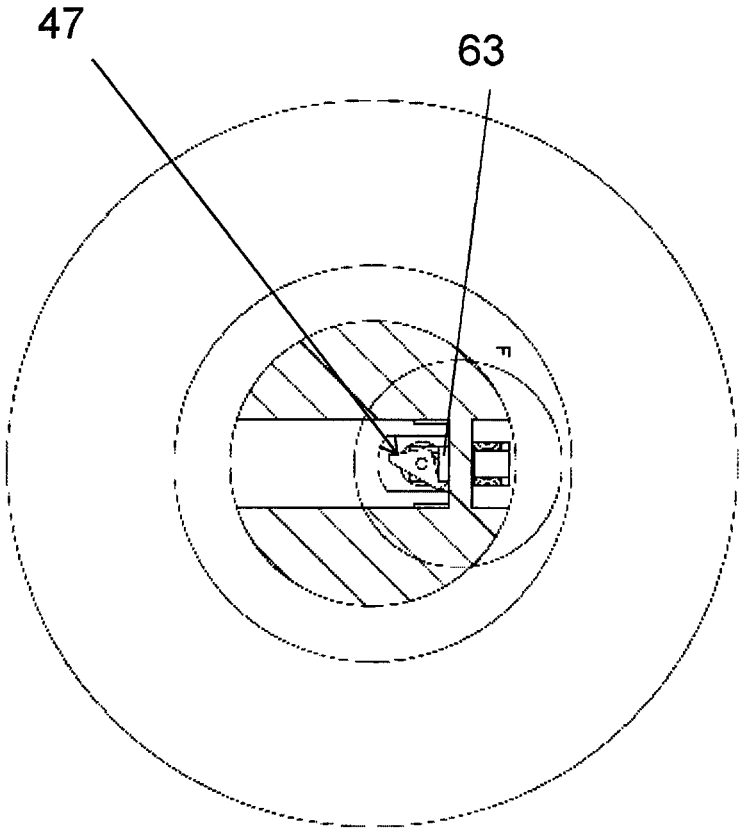
FIG. 12 is a cross-sectional view through XII from FIG. 11.
Figure 12F:
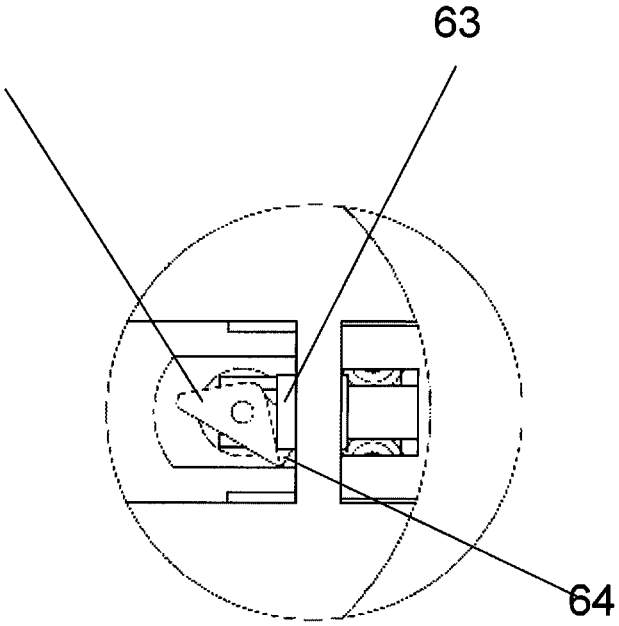
FIG. 12F is a detailed view of area F from FIG. 12.

In contrast FIGS. 10 to 12F illustrate the actuator 5 in the operable condition whereby rotation of the hand engageable portion 4 from the position as illustrated in FIG. 6 to the position as illustrated in FIG. 10 results in retraction of the cover 49 but not the catch 48 of the interlocking arrangement. FIG. 10 illustrates the distal end of the catch 48 remaining in the extended position overlapping with the flange 62 on the drive member 33. It can be appreciated from FIG. 11 that the lower leg 63 of the catch 48 is retained in a forward position relative to the position illustrated in FIG. 8, and can be more clearly appreciated from FIG. 11E that the shoulder 64 on the blocking member 47 is positioned behind the lower leg 63 on the catch 48. Referring now to FIG. 12 which illustrates the blocking member 47 having been rotated in an anti-clockwise direction from the position as illustrated in FIG. 9, and it can be appreciated more clearly from FIG. 12F that the shoulder 64 is now located behind the lower leg 63 of the catch 47.

The alternate embodiment illustrated in FIG. 13 includes an interlocking arrangement including a pin 182 which is movable relative to the shaft 144 on operation of the electrical adjuster 146. The pin is movable from a retracted position whereby it is retracted within the shaft 144, to an extended position whereby it extends between the shaft 144 to locate within one of four recesses 183 formed in the single drive member 133.

It ought to be appreciated from the foregoing that the padlock assembly utilising the first influencing arrangement to facilitate retaining the lock mechanism 31 in the active condition will be less susceptible to unauthorised manipulation from outside the body 2.

Various alterations and/or additions may be introduced into the padlock assembly as hereinbefore described without departing from the spirit or ambit of the invention.

Future patent applications may be filed in Australia or overseas on the basis of or claiming priority from the present application. It is to be understood that the following provisional claims are provided by way of example only, and are not intended to limit the scope of what may be claimed in any such future application. Features may be added to or omitted from the provisional claims at a later date so as to further define or re-define the invention.

The invention claimed is:

1. A padlock assembly including a body, a shackle movable relative to the body between an open position and a closed position, a lock mechanism that when in an active condition can retain the shackle in the closed position and in an inactive condition can allow the shackle to move to the open position, an actuator mechanism including a hand engageable portion that is external to the body and is manually movable relative to the body, the actuator mechanism being electrically controlled to adjust between and operable condition and an inoperable condition, a coupling mechanism acting between the lock mechanism and the actuator mechanism, a first influencing arrangement that facilitates retaining the lock mechanism in the active condition, wherein when the actuator mechanism is in the operable condition movement of the hand engageable portion causes the lock mechanism to adjust from the active condition to the inactive condition.

2. The padlock assembly according to claim 1 wherein the coupling includes a drive member which is impeded from moving from a first position by the first influencing arrangement and is movable from the first position when the actuator is operable.

3. The padlock assembly according to claim 2 wherein the first influencing arrangement includes at least one first magnet associated with the drive member urging the drive member to remain in the first position, and the first influencing arrangement includes at least one second magnet that is fixed relative to the body.

4. The padlock assembly according to claim 3 wherein the first influencing arrangement includes at least one third magnet that is located between the at least one second magnet and the at least one first magnet when the drive member is in the first position.

5. The padlock assembly according to claim 3 wherein the at least one first magnet, the at least one second magnet and at least one third magnet each include four magnets equally spaced about an actuator axis about which the actuator mechanism rotates, and each of the first magnets, the second magnets and the third magnets are aligned and spaced radially from the actuator axis when the drive member is in the first position.

6. The padlock assembly according to claim 5 including a second influencing arrangement that facilitates retaining the hand engageable portion in a preferred position relative to the drive member, wherein the actuator includes a shaft that is locatable within the body, a distal end of the shaft being configured to accommodate the drive member, the second influencing arrangement includes at least one fourth magnet associated with the shaft of the actuator mechanism, and the drive member includes a head portion and the second influencing arrangement includes at least one fifth magnet associated with the head portion of the drive member.

7. The padlock assembly according to claim 6 wherein the at least one fourth magnet and at least one fifth magnet each include two magnets spaced about the actuator axis, wherein each of the two fourth magnets and two fifth magnets are on opposed sides of the actuator axis, and each of the two fourth magnets are repulsed by each of the two fifth magnets.

8. The padlock assembly according to claim 7 wherein the distal end of the shaft is configured to capture the head portion of the drive member so as to be rotatable relative thereto.

9. The padlock assembly according to claim 6 wherein the actuator mechanism includes a shaft that is locatable within the body, a distal end of the shaft being configured to interact with the drive member, and the second influencing arrangement includes at least one fourth magnet associated with the shaft of the actuator mechanism, and the second influencing arrangement includes at least one fifth magnet associated with the drive member.

10. The padlock assembly according to claim 9 wherein the at least one fourth magnet include two magnets spaced about the actuator axis and the at least one fifth magnet include four magnets spaced about the actuator axis, and the two fourth magnets are on opposed sides of the actuator axis, and the two fourth magnets are attracted to the two fifth magnets.

11. The padlock assembly according to claim 1 wherein the lock mechanism includes a cam having at least one cam surface, and at least one detent to interact with the at least one cam surface, and the shackle is configured with at least one recess for receiving the at least one detent when the shackle is in the closed position and the lock mechanism is in the active condition, lock mechanism also including a biasing arrangement for biasing on the cam.

12. The padlock assembly according to claim 11 wherein the biasing arrangement includes a spring and an abutment plate, one end of the spring acting on the cam and another end of the spring acting on the abutment plate, whereby the abutment plate is fixed from rotating about the actuator axis.

13. The padlock assembly according to claim 12 wherein the coupling mechanism includes a driven member that has a distal side configured to drivingly engage with the cam so that rotation of the driven member causes rotation of the cam against the action of the spring, and the driven member includes a proximal side configured to drivingly engage with the drive member so that rotation of the drive member causes rotation of the driven member, and the drive member includes a distal side configured to drivingly engage with the cam so that rotation of the driven member causes rotation of the cam against the action of the spring.

14. The padlock assembly according to claim 1 wherein the actuator mechanism includes an interlocking mechanism that is electrically controlled so that the actuator mechanism is adjustable between the operable condition and the inoperable condition.

15. The padlock assembly according to claim 14 wherein the interlocking mechanism includes a catch movable between an extended position and a retracted position with the actuator mechanism adopting the operable condition when the catch is in the extended position.

16. The padlock assembly according to claim 15 wherein the interlocking mechanism includes a biasing member for biasing the catch towards the extended position and a selectively operable blocking mechanism for blocking the catch from moving towards the retracted position.

17. The padlock assembly according to claim 16 wherein the selectively operable blocking mechanism includes a blocking member and an electrical adjuster which adjusts the orientation of the blocking member relative to the catch between a blocked position and an un-blocked position.

18. The padlock assembly according to claim 14 wherein the interlocking mechanism includes an electrical adjuster that is operable to move a movable member between an extended position and a retracted position whereby the actuator adopts the operable condition when the movable member is in the extended position.

19. The padlock assembly according to claim 18 wherein the movable member interacts with a recess in the coupling mechanism when it is in the extended position.

20. The padlock assembly according to claim 19 including an electronic authorization arrangement for receiving and processing a signal from an authorization key, and controlling operation of the electrical adjuster on receipt of an authorized key.

* * * * *